US006896394B2

(12) United States Patent
Houle

(10) Patent No.: US 6,896,394 B2
(45) Date of Patent: May 24, 2005

(54) RECESSED LIGHT FIXTURE

(75) Inventor: Jacques Houle, Boisbriand (CA)

(73) Assignee: #9060-0495 Quebec, Inc., Quebec (CA)

( * ) Notice: Subject to any disclaimer, the term of this patent is extended or adjusted under 35 U.S.C. 154(b) by 0 days.

(21) Appl. No.: 10/161,275

(22) Filed: May 31, 2002

(65) Prior Publication Data

US 2003/0223240 A1 Dec. 4, 2003

(51) Int. Cl.[7] ..... F21S 8/04
(52) U.S. Cl. ..... 362/365; 362/364; 362/147
(58) Field of Search ..... 362/364, 365, 362/147, 148; 248/27.1

(56) References Cited

U.S. PATENT DOCUMENTS

| | | | | | |
|---|---|---|---|---|---|
| 2,965,348 | A | | 12/1960 | Gerstel et al. | 248/343 |
| 3,018,083 | A | | 1/1962 | Bobrick | 248/343 |
| 3,560,732 | A | * | 2/1971 | Green | 362/451 |
| 3,675,807 | A | * | 7/1972 | Lund et al. | 220/3.94 |
| 3,885,147 | A | * | 5/1975 | Chacon | 362/408 |
| 4,175,281 | A | | 11/1979 | Lonseth | 362/148 |
| 4,232,361 | A | | 11/1980 | Kelsall | 362/364 |
| 4,238,815 | A | | 12/1980 | Price | 362/218 |
| 4,250,540 | A | | 2/1981 | Kristofek | 362/368 |
| 4,431,151 | A | | 2/1984 | Schonasky | 248/27.1 |
| 4,739,460 | A | * | 4/1988 | Kelsall | 362/365 |
| 5,567,041 | A | * | 10/1996 | Slocum | 362/148 |
| 5,609,414 | A | * | 3/1997 | Caluori | 362/366 |
| 5,725,302 | A | * | 3/1998 | Sirkin | 362/365 |
| 5,941,625 | A | * | 8/1999 | Morand | 362/148 |
| 5,944,412 | A | * | 8/1999 | Janos et al. | 362/365 |
| 6,000,818 | A | | 12/1999 | Caluori | 362/365 |
| 2002/0131271 | A1 | | 9/2002 | Schubert et al. | 362/365 |

* cited by examiner

*Primary Examiner*—Sandra O'Shea
*Assistant Examiner*—Hargobind S. Sawhney
(74) *Attorney, Agent, or Firm*—Cook, Alex, McFarron, Manzo, Cummings & Mehler, Ltd.

(57) ABSTRACT

A recessed light fixture includes spring steel mounting clips having a first portion fixed to the outside of the cylindrical housing and having a second portion extending through an inverted T aperture in the sidewall housing. For use, the fixture is positioned in a hole and the user pushes the free end of the mounting clip through its aperture. A neck near the free end will then reach the aperture and the tension of the spring steel mounting clip will push the free end upward, with the narrowed neck guided within the longitudinal portion of the inverted T. The expanded portion around the neck restrains the clip from disengaging accidentally. In this second position, the outer portion of the clip is pushed away from the housing to engage and/or inhibit the movement of the fixture relative to the ceiling. The clip has a concave portion, a bend, and a convex portion outside the housing in this second position. Also disclosed is a twist off detachable junction box at the top of the housing.

19 Claims, 3 Drawing Sheets

RECESSED LIGHT FIXTURE

BACKGROUND OF THE INVENTION

The present invention relates to improvements in a recessed light fixture or luminaire. Aspects of the present invention concern the mounting clips therefore and their relationship to the device. The invention further concerns the electrical junction box associated with the fixture.

Recessed lighting fixtures have been known for several decades and are in widespread use today. The fixture will hold either an incandescent lamp or lamps or other type of lamps, including flourescent or other gas-filled lamps using, for example, the noble gases e.g., halogen lamps, xenon lamps, etc. Typically, such recessed fixtures are mounted at a ceiling or ceiling panel, and electrical wiring to supply power for the fixture is run above the ceiling or ceiling panels, connecting suitably to the fixture.

A great deal of attention has been given to the manner in which the recessed lighting fixtures are attached. A wide variety of mounting clips have been devised for this function.

Many of these mounting clips are completely external to the light fixture housing. U.S. Pat. No. 5,725,302 issued to Sirkin describes, for example, a mounting clip for a "pot light" where the clip does not require any holes or openings in the wall of the housing of the light fixture in order to operate. Sirkin shows a mounting Clip C having a portion to be positioned below the ceiling and penetrate the ceiling board (typically made of gypsum), another portion lying above the ceiling board, and a third portion or projecting arm which is to "bite into the exterior surface of the side wall" of the light fixture. Sirkin mentions that the light fixture can be removed from the ceiling or soffit using a twisting movement without being damaged by the mounting clips C.

U.S. Pat. No. 6,000,818 issued to Canlyte, Inc. on the application of Caluori discloses a mounting clip for mounting a recessed light fixture into a panel. The clip described there includes a resilient arm biased toward the housing of the light fixture which frictionally engages the housing to support the fixture in the panel. The clip is located outside the housing itself and has a portion which descends from the top of the ceiling to the bottom of the ceiling panel, and includes an upward projecting tooth for penetrating the more common panel materials, be they made of plaster, wood, aluminum, or gypsum wallboard.

U.S. Pat. No. 3,018,083 to SunBeam Lighting Co. on the application of Bobrick is directed toward a recessed ceiling light fixture having means which automatically swings into position a supporting flag tab configuration. The flag tabs are automatically turned out to engage the ceiling joists or structural members which outline the opening in the ceiling to receive the fixture.

U.S. Pat. No. 3,885,147 to Lightcraft of California on the application of Chacon discloses another type of mounting clip used, for example, on fixture supported brackets or wall mounted channel members.

It is also known to combine a mounting clip, completely external to the recessed lighting fixture, with a further device such as a screw or the light to penetrate from the interior of the fixture through a sidewall and into the mounting clip, as shown in U.S. Pat. No. 4,431,151 (Schonasky et al.) FIG. 3.

Another arrangement specifically contemplates openings in the light fixture for cooperation with mounting clips or structures which in operation are essentially external. For example, U.S. Pat. No. 2,965,348 to Gotham Lighting Corporation on the application of Gerstel and Langer discloses a receptacle pan A to receive and house a lighting fixture. A clamping device has a main outside element C which contacts the upper surface of the ceiling, external to the pan A, but includes an end portion which extends through a slot structure D on the side of the pan. As shown, a nut and bolt arrangement fixes the clamp C to the pan A. This reference also shows that the slotted aperture on the side of the housing has a unique shape which might be described as a modified cruciform or a multiple cruciform configuration having a main transverse opening 17 below a head 16, beneath which an elongated slot 18 extends downward (toward the ceiling). A plurality of location notches are shown on the sides of the slot 18. The main clamping element C has a relatively sharp bottom corner which "cuts into and wedges into the interior face . . . of the ceiling." The clamp C has a narrow neck portion extending from the main bottom of clamp C up to a transverse "hammerhead" portion 31. This cooperates with a second structure on the interior of the fixture through which a bolt extends. As described in Gerstel et al., the enlarged hammerhead portion 31 will pass through the transverse enlargement 17 of the slot on the pan A and can be fitted through an appropriate aperture on the inside bracket portion. As thus assembled, before tightening, the inside portion bolted to the outside mounting clamp C can be moved vertically as needed and then tightened. It does not appear that the entirety or even a significant portion of the outside mounting clamp C will begin within the interior of the fixture A and then be extended through the transverse opening 17 to the outside of the fixture.

U.S. Pat. No. 4,250,540 issued to McGraw-Edison Co. on the application of Kristofek shows another mounting arrangement involving an opening in the sidewall or housing of a light fixture. The sidewall opening is in a "T" configuration. There are ratchet teeth on the outside of the light fixture which cooperate with a portion of the mounting clip. FIGS. 5–7 show how the mounting clip is extended from the inside of the light fixture through the transverse portion of the "T" opening, articulated, and placed into operative position. In this structure, a free end 45 at the bottom of the mounting clip along with a bent knee 43 both contact the upper surface of the ceiling panel. The top of the clip engages the ratchet teeth preventing vertical movement of the fixture.

U.S. Pat. No. 4,739,460 issued to Cooper Industries, Inc. on the application of Kelsall. This patent shows another arrangement of spring clips for mounting a recessed light fixture in a ceiling. The clips are disposed in respective elongated longitudinal slots in the sidewall of a cylindrical portion of the fixture and are located inside the housing during shipment and prior to installation. The clips are adapted to rotate outwardly, in use, for securing the housing above the ceiling in an installed position. These clips have a unique shape both in elevational view and plan view, as shown in the patent. The openings in the sidewall of the light fixture are not illustrated clearly in this reference, but they are described as "a pair of opposed elongated slots which are vertically aligned within the wall . . . of the can housing . . ." As described at Col. 2, "prior to installation of the housing through a mounting hole or opening 20 in the ceiling 12, a pair of snap spring clips 14 are contained substantially in their entirety within or inside of can housing 10, so that a portion of the clips are flush with the outer surface of the wall 18. This permits can housing 10 to be raised vertically through and pushed substantially above ceiling opening 20. In use, the spring clips 14 are rotated outwardly to bear against the upper sub-ceiling surface 22 for retaining securely can housing 10 within the ceiling as will be explained in greater detail hereinafter." FIG. 6 of Kelsall shows a first position of the spring clips 14 during shipping and prior to the clips being placed into the operative position. FIG. 7, on the other hand, shows a second position after the clips have been rotated from the first position (primarily within the recessed can) to a position largely outside of the can, although a section of the clip remains within the can, parallel to and abutting the sidewall thereof. Generally speaking, from the vertical portion of the mounting clip which remains within the fixture, a diagonal portion extends outward therefrom through an aperture and at a remote end recurves back upon itself so that a foot portion 28 bears against the upper surface of the ceiling. This clip, therefore, is not fixedly fastened to the housing.

U.S. Pat. No. 5,941,625 issued to Bazz, Inc. on the application of Morand shows another arrangement wherein a clip has a vertical portion which remains on the inside of the fixture, parallel to the sidewall, has a diagonal portion on the outside, and has a foot or "horizontally extending edge 36" for contacting the ceiling structure.

Still further mounting clips and other arrangements for mounting recessed lighting are shown in U.S. Pat. No. 4,175,281 (Lownseth); U.S. Pat. No. 4,232,361 (Kelsall); and U.S. Pat. No. 4,238,815 (Price).

An object of the present invention is to provide an improved mounting clip arrangement for a recessed lighting fixture.

An independent object of the present invention is to make other improvements in the recessed lighting fixture.

SUMMARY OF THE INVENTION

A recessed light fixture has an improved mounting clip arrangement. During shipment and prior to installation, the mounting clip is in a first non-extended position wherein some of the mounting clip is located outside the housing of the fixture, and some of it is located inside. The fixture is inserted into a suitable hole in the ceiling or wall, and then the portion of the mounting clip which is on the inside of the fixture is manually pushed outward. In so doing, the outer perimeter of the mounting clip outside of the fixture is moved beyond the hole into which the fixture was inserted. At a certain point, a neck on the mounting clip seats in a longitudinal portion of an aperture on the fixture, which is the second position of the mounting clip. Preferably the mounting clip is affixed at one end to the housing and in the second position is under tension which urges the clip inward, as constrained by the aperture through which the clip passes. Preferably, multiple clips are provided, each in a respective aperture.

For removal of the fixture, the user reaches into the open end of the fixture, pulls down the free end of the mounting clip, moves the neck down through the longitudinal portion of the aperture, and then moves the clip (or permits the clip to move) through the horizontal (circumferential) portion of the aperture. Once all of the clips are released in this manner, the fixture can be withdrawn through the hole in the ceiling or wall.

Another feature of the preferred embodiment of the present invention is that at the top of the recessed light fixture, a junction box is detachable through a twist arrangement, without requiring screws or the like to affix the junction box to the remainder of the fixture. At least one pin or nib is provided on the fixture body and the junction box includes a slotted opening with an extension to the bottom perimeter of the junction box for passage of the nib. After the junction box is seated over the nib, it is rotated to seat the nib into the slotted opening thereby preventing axial movement thereafter.

BRIEF DESCRIPTION OF THE DRAWINGS

In describing a preferred embodiment, reference is made to the accompanying drawings wherein like reference numerals correspond to like parts and wherein.

DESCRIPTION OF THE PREFERRED EMBODIMENT

Figure 1:
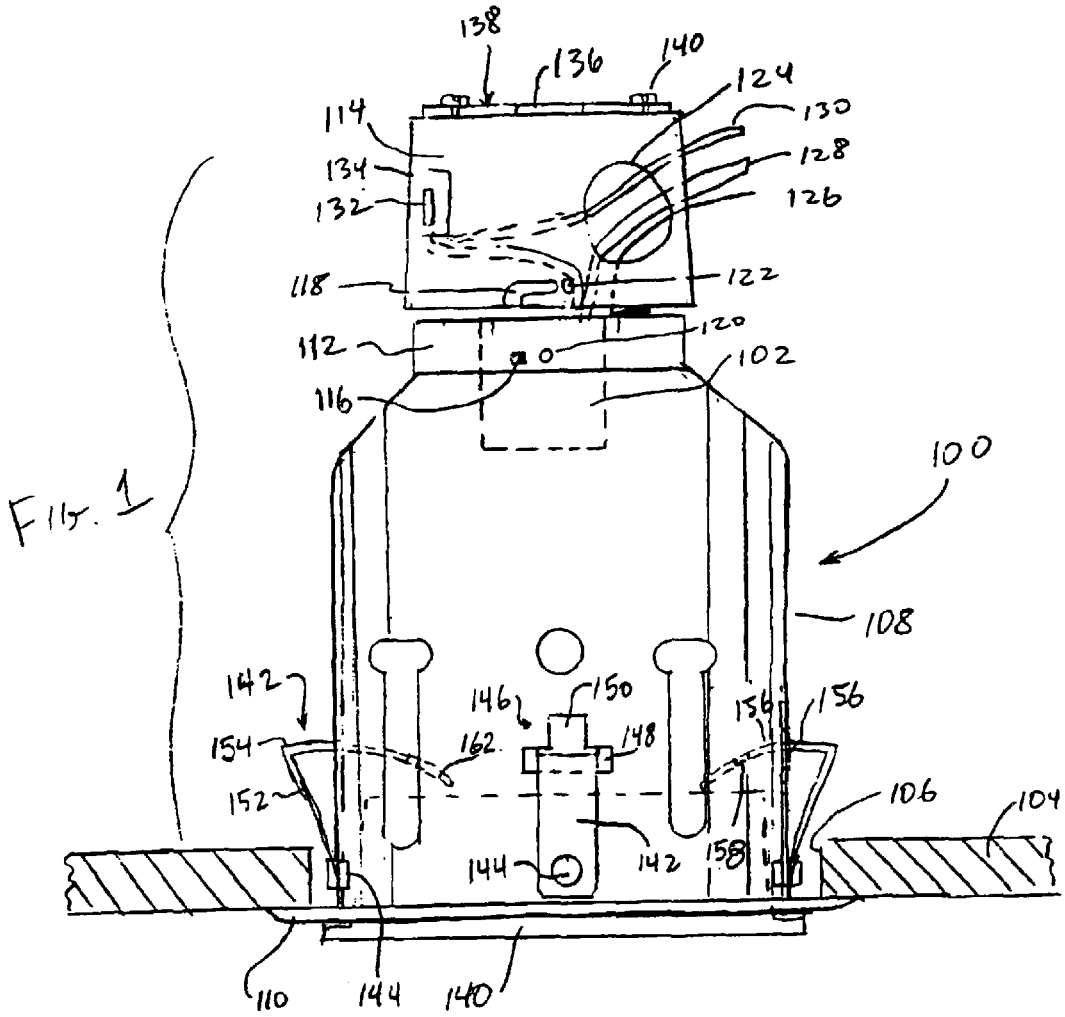
FIG. 1 is an exploded view of a recessed light fixture embodying various principles of the present invention.

Reference is made to FIG. 1 which illustrates an exploded side view of a recessed light fixture 100 according to various aspects of the present invention. The illustrative light fixture is a luminaire for containing a flourescent, incandescent, or other bulb in a socket or other mount, represented at 102. Recessed light fixture 100 is shown in position relative to a ceiling member 104 having a circular hole 106 therein. Fixture 100 includes a generally cylindrical housing 108 as a main body portion. At the bottom of cylindrical housing 108 is a flange 110 having an outside diameter greater than that of the ceiling hole 106. At the upper end of the fixture, cylindrical housing 108 curves or tapers inward to a neck portion 112 which is also generally cylindrical and may include a very slight conical aspect but still is generally cylindrical. A receptacle housing 114 is illustrated just above housing 108 for sake of illustration. Receptacle 114 is also called the "junction box." Generally a conical section or cylinder, at its bottom portion its inside diameter is just slightly larger than the outside diameter of neck 112 so that junction box 114 can be pressed manually onto the neck 112 and have a snug fit. However, more affirmative engagement is provided in the illustrated embodiment in the form of a pin or nib 116 which extends radially outward from neck 112 a short distance on the order of 1 millimeter. A corresponding channel 118 is formed in junction box 114. It will be understood that when junction box 114 is maneuvered onto neck 112, the user will position channel 118 so that its mouth will overlie pin 116. After suitable downward movement of junction box 114 onto neck 112, an elongated portion of channel 118 extending generally horizontally i.e. circumferentially, will be in line with the pin and the whole junction box 114 can then be rotated clockwise until the pin is seated at the bottom of channel 118. Preferably, a plurality of such channels and pins are used on the junction box 114 and neck 112. Additionally, a hole 120 is preferably located in neck 112 beside one such pin 116 and a corresponding hole 122 is located in junction box 114 so that when the junction box is properly seated on the cylindrical housing and suitably rotated, a sheet metal screw (not shown) can be fitted through holes 120 and 122 to prevent rotational movement therebetween. It will be understood that in an alternate design, one could place pins 116 on the junction box and the channels 118 on the neck 112.

Junction box 114 will have at least one punch-out hole for connecting cable armor or the like, and a punched-out hole 124 is shown. Three wires are represented, including a ground wire 126, a first power wire 128, and a second power wire 130 which can be connected to a thermal protection chip represented at 132 within a separate mount 134. In addition to having a punch hole 124 on the periphery of junction box 114, an additional punch hole 136 is located on top of a flat, circular top plate 138 mounted on the top of junction box 114. Top plate 138 is held to the top of junction box 116 by screws 140 or the like. Preferably the upper surface of junction box 114 has a large circular aperture (not shown) which is covered by the top plate 138.

At the bottom of fixture 100 a bezel 140 is shown in FIG. 1. Bezel 140 is omitted from the bottom view of FIG. 3, but it will be understood that bezel 140 is a completely removable member, typically made of plastic, which is friction fit on the inside diameter of housing 108.

The mounting clips used in the recessed light fixture 100 are shown in all of the Figures. Illustratively, three spring clips 142 are used, each made of spring steel about one-half an inch in width, illustratively. It will be understood that part of each mounting clip 142 will be located outside the cylindrical housing 108, generally at the bottom portion thereof (i.e. the portion that aligns with the wall or ceiling) and it will extend through a corresponding aperture in the housing body so that a minor portion of the clip will be located within the cylindrical housing 108. Preferably, the each mounting clip 142 is secured to the lower portion of cylindrical housing 108, on the outside thereof, by a rivet 144 or the like passing through the mounting clip and the cylindrical housing just above the flange 110. It will be understood that each mounting clip 142 is movable between a first position suitable for inserting the fixture 100 into the hole 106 in the ceiling 104, and a second position in which the mounting clip is extended radially outward in a manner to be described, for holding the fixture 100 in position relative to the ceiling 104.

Figure 2B:
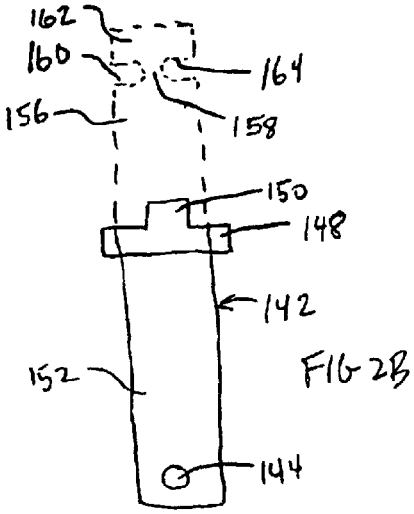
FIG. 2B is a representation of one mounting clip, in an unbent condition, in an inverted T aperture of the housing.
Figure 2A:
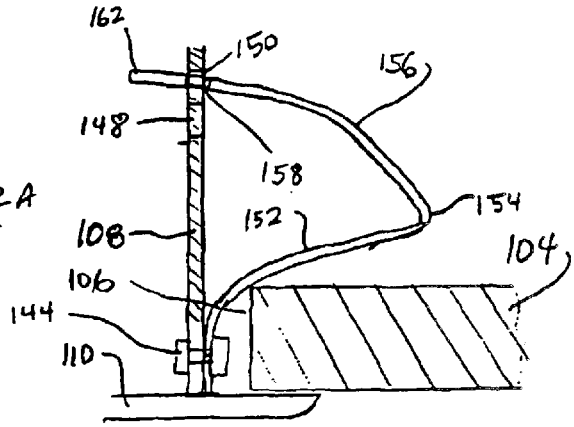
FIG. 2A shows a portion of the embodiment in FIG. 1, but in an installed position.
Figure 3:
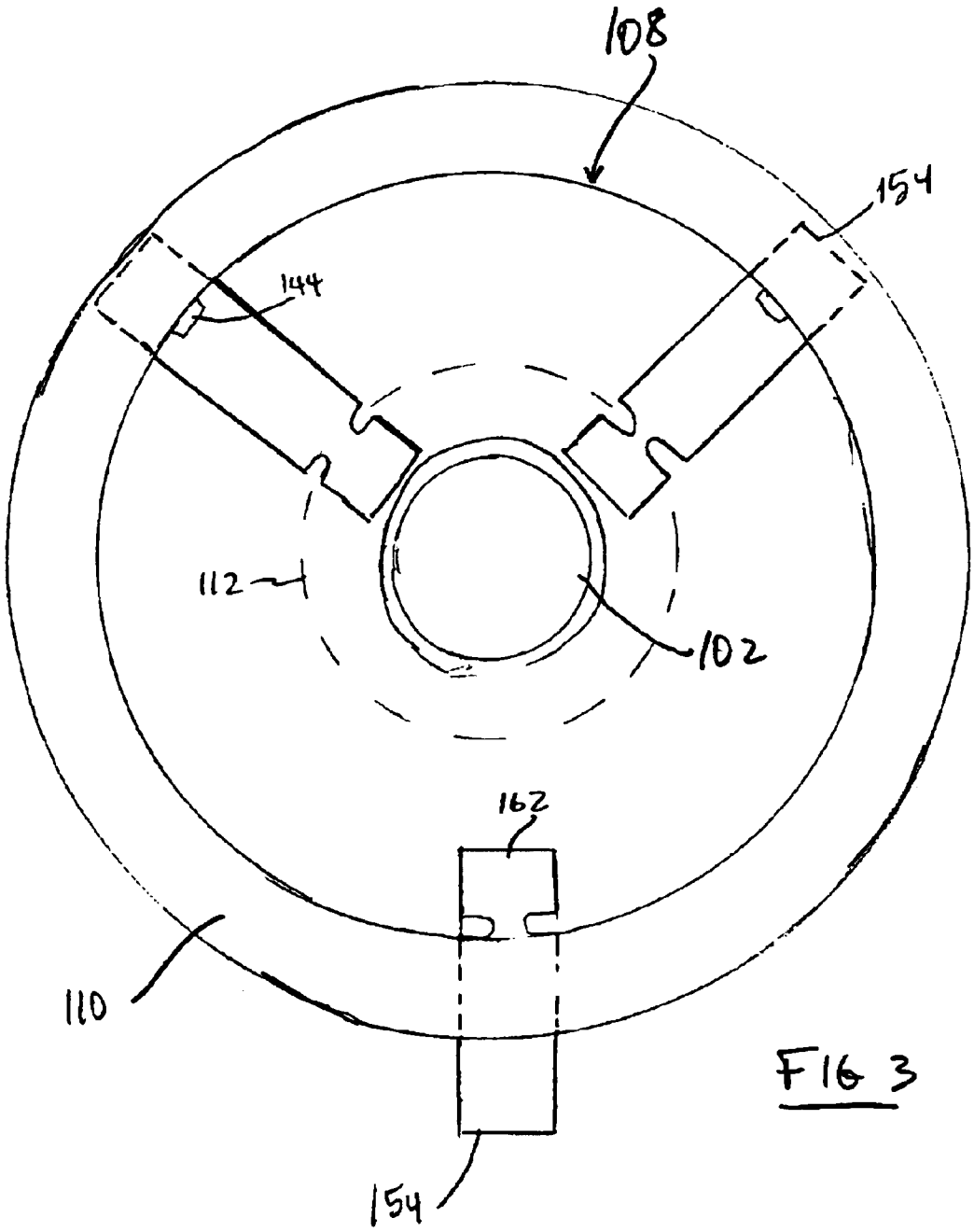
FIG. 3 is a bottom view showing two of the mounting clips in the position illustrated in FIG. 1 and one mounting clip in the position illustrated in FIG. 2A, i.e. the operative position.
Figure 4:
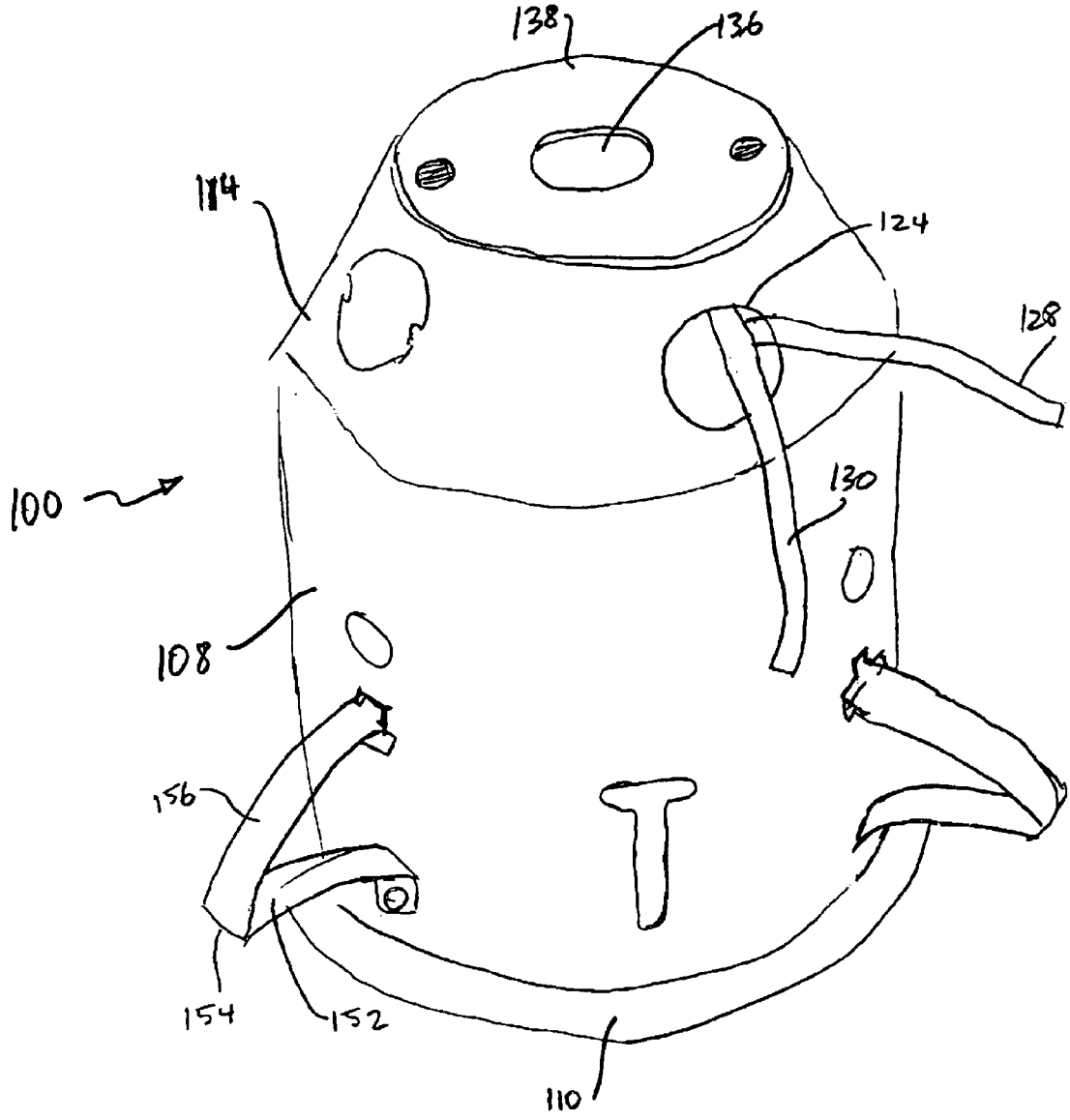
FIG. 4 is a rear orthogonal view of the recessed light fixture with the mounting clips expanded and the junction box fully seated on the neck.

These two positions are illustrated in the figures. FIG. 1 shows the mounting clips 142 in the first (withdrawn) position, ready for installation. FIG. 2A shows one mounting clip after it has been extended into the second (extended) position. FIG. 3 shows two of the mounting clips in the first position and a third one in the second position. FIG. 4 shows a perspective view with two of the mounting clips in the second position.

For each mounting clip 142, an aperture having a horizontal component and vertical component communicating with the horizontal component is formed in cylindrical housing 108. Preferably this is an "inverted T" shape. A front view of such a T aperture 146 is shown in the lower center part of FIG. 1. As can be seen, a horizontal portion 148 of the aperture 146 is provided. (As used herein, the "horizontal" direction is parallel to the plane of the ceiling 104. A vertical portion 150 extends upward from the horizontal portion 148. The width of mounting clip 142 is smaller than the width of horizontal portion 148 but larger than the width of vertical portion 150 so that the clip 142 can pass freely through the horizontal portion 148 but not the vertical portion 150. It will be understood that the horizontal portion 148 is circumferential on a cylindrical surface, and that the vertical portion 150 is longitudinal.

As shown in FIG. 1, mounting clip 142 includes a first portion 152 which is fixedly fastened to the housing 108 by rivet 144. In the first position, first portion 152 then makes an acute angle with the vertical outer surface of cylindrical housing 108. Proceeding further along mounting clip 142, a bend 154 is shown as the part of clip 142 which is most radially outward from the housing. The portion of clip 142 beyond the bend 154 is referred to as a second portion 156. That second portion 156 extends back toward cylindrical housing 108 and extends through the horizontal portion 148 of the inverted T aperture 146. Typically, clip 142 is made of spring steel, and the second portion 156 will be arcuate.

Near the extremity or free end of second portion 156 of the mounting clip 142, a neck 158 is formed. Neck 158 is a narrowed portion relative to the body of mounting clip 142. At the base of the neck, a pair of shoulders 160 are present. Above the neck, the remaining part of the mounting clip forms a head or tab 162. Head 162 has lower surfaces 164 beside neck 158, opposing shoulders 160. This construction is represented in FIG. 2*b*, but it must be understood that in FIG. 2*b*, mounting clip 142 is represented as though it had no bend 154 in the clip. This representation is for purposes of description. It will be understood that clip 142 as implemented will have a bend 154.

The size of head 162 should be large enough so that it can be grasped by the fingers or a tool, as will be explained below. Typically, the height of head 162 may be on the order of ⅜ of one inch.

As seen in FIG. 1, the first portion 152 of mounting clip 142 forms a generally straight ramp, which could be curved in another embodiment, so that the bend 154 is located some small distance radially outward and away from cylindrical housing 108. Preferably, bend 154 in this first position is no further outward from housing 108 than is the end of flange 110. For insertion of the fixture 100 into the round hole 106 in the ceiling, the user may manipulate the fixture so that the mounting clips are above the ceiling. If necessary or helpful, the user may manually grasp the second portion 156 from within the cylindrical housing 108 and pull it radially inward so that the first portion 152 of mounting clip 142 which is outside of the housing is drawn flush against the outer surface of the cylindrical housing 108, thereby permitting passage of the fixture 100 into the hole 106. As shown in FIG. 1, when the fixture 100 is oriented within the hole 106, the mounting clips 142 generally are not in contact with any part of the ceiling 104.

To secure fixture 100 in place, the user now pushes on the portion of the mounting clips 142 within housing 108 to push in a radially outward direction. As each mounting clip 142 is pushed radially outward, it flexes, and the outside surface of the first portion 152 bends in a concave curve. The bend 154 of the clip 142 will now be extended to a point beyond the ceiling hole 106, and preferably the first portion 152 of the mounting clip will contact a corner or upper surface of ceiling 104, as represented in FIG. 2*a*.

The arrangement of the neck 158 and inverted T provides a locking mechanism to keep the mounting clip in this orientation. Specifically, when the head portion 162 draws sufficiently near to the side wall of housing 108, the neck 158 will enter the inverted T aperture 146. Because the width of the neck 158 is smaller than the width of the opening at vertical portion 150, the tension being exerted by the mounting clip will push the free end of the clip upward so that the neck 158 comes to rest at the upper-most portion of vertical portion 150. This is the second position. Now the shoulders 160 of clip 142 are located on the outside of housing 108 directly against the side wall. The outer surface of the second portion 156 of mounting clip 142 presents a convex surface at this time, and, as mentioned, the outer surface of the first portion 152 presents a concave portion. In this (second) position, the majority of each mounting clip 142 has been moved out of the inside of the cylindrical housing 108, and essentially only the heads 162 remain therewithin. The mounting clips have extended the effective diameter of fixture 100, as seen most plainly in FIG. 3, where the bottom mounting clip 142 is shown in the second position with the upper two mounting clips shown in the first position. Typically, the diameter of the housing, that is to say, the distance of the bend 154 from a radius of the fixture 100 will be 0.5 inches or more beyond the outer periphery of flange 110. Hence, this extension prevents the fixture 100 from falling through the aperture 106 in the ceiling. Additionally, any downward movement of fixture 100 from the ceiling will be met with increased resistance as the mounting clips 142, and particularly the first portions 152 thereof, will contact the upper surface of the ceiling 104 and will resist further downward movement, since the neck 158 is locked in the vertical portion 150 of the inverted T aperture.

If the user desires to withdraw fixture 100 from the ceiling, this can be done simply by grasping the head portion 162, moving it downward within the vertical portion 150 until the neck portion reaches the horizontal portion 148 of the aperture. At that time, the shoulders 160 and the rest of the second portion 156 will push through aperture 148 due to the flexible, resilient, spring nature of the clip providing sufficient tension. The mounting clips will move to the first position and can be pulled further into the housing 108 manually to permit withdrawal of the fixture 100 through the ceiling hole 106.

The illustrated description of the preferred embodiment according to inventive features should facilitate the construction of a recessed light fixture by persons who are working in this field. Construction details are very well known in the industry, but it may be noted that, for example, the junction box and the housing can be zinc plated, painted, or electroplated steel, or formed of other materials. The mounting clips can be made of stainless steel having a thickness of approximately 20 mils or approximately 0.5 millimeter. Its width can be on the order of 0.5 inches but can be smaller or wider as desired. The mounting clips can be secured to the housing 108 by rivets, screws, welds, or other devices for attachment. The bezel may be formed of a plastic or phenolic which is illustratively two millimeters thick and it may be detachably secured to the housing 108 via a plurality of suitable spring clips.

It will be appreciated that the foregoing description has been for illustrative purposes only and that the scope of protection for the present invention is to be determined in accordance with the accompanying claims along with equivalence thereof. The skilled artisan will appreciate that the present invention is capable of several variations which do not depart from the scope and spirit of the present invention. For example, while the preferred aperture in the housing for securing the mounting clips has been described as an inverted T, other shapes can be used, and other configurations which use a resilient or flexible mounting clip that is locked into a second position but which is able to be unlocked from that second position.

What is claimed is:

1. A light fixture to be mounted within a hole in a wall or ceiling comprising:

a housing having a main body portion smaller than the hole;

a mounting clip;

a mounting clip aperture in said main body portion, said mounting clip corresponding to and extending through said aperture; said mounting clip aperture including a vertical portion and a horizontal portion communicating therewith, wherein said horizontal portion is wider than said vertical portion;

wherein said mounting clip includes a neck portion and an adjacent shoulder portion, wherein said neck portion is narrower than said vertical portion of said clip aperture and wherein said shoulder portion is narrower than said horizontal portion of said clip aperture but wider than said vertical portion of the clip aperture;

said mounting clip being affixed to said housing at least at one point;

said mounting clip being movable through said aperture between a first position and a second position, said first position corresponding to a pre-installation mode and said second position corresponding to an installed mode;

said mounting clip including a first portion located on the outside of the housing and a second portion at least part of which is located within said housing when said clip is in said first position;

wherein said mounting clip in said first position permits the housing to be inserted into the wall or ceiling hole;

wherein said mounting clip in said second position is extended outward from said housing so that a maximum distance between an outer periphery which includes said mounting clip is larger than the hole, so that the mounting clip in said second position blocks withdrawal of the fixture from the wall or ceiling hole;

wherein said mounting clip in said first position is accessible from the interior of the main housing and is movable through said aperture;

said mounting clip aperture and mounting clip being configured to lock said mounting clip in said second position; and wherein in said second position, said neck portion of said mounting clip extends through said vertical portion of said aperture, said shoulder portion is located outside said housing, and said mounting clip urges said shoulder portion against said vertical portion, thereby to retain said mounting clip in said second position.

2. The fixture of claim 1 wherein said housing is cylindrical and said mounting clip is tensioned to move radially inward from said second position to said first position.

3. The fixture of claim 1 wherein said fixture includes a plurality of mounting clips and corresponding mounting clip apertures.

4. The fixture of claim 3 wherein each of said mounting clip apertures includes an inverted T shape.

5. The fixture of claim 8 wherein each said mounting clip is flexible, resilient, and tensioned to move from the second position into the first position.

6. The fixture of claim 5 wherein each said mounting clip includes a first portion and a second portion, wherein said first portion is located outside said housing in both said first and second positions;

wherein said second portion is located partially within said housing and partially outside said housing in said first position; and wherein a majority of said second portion is located outside said housing in said second position.

7. The fixture of claim 6 wherein said first portion has an outside surface which in said first position of said clip is not substantially concave but which in said second position is concave in shape.

8. The fixture of claim 7 wherein when said mounting clip is in said second position, an outer surface of said second portion of said clip outside said housing is convex in shape.

9. The fixture of claim 8 wherein said second portion of said mounting clip in said first position is substantially radial with respect to a longitudinal axis of the cylindrical housing.

10. The fixture of claim 8 wherein said mounting clip is made of spring steel.

11. The fixture of claim 5 further comprising a flange at a mouth of said housing.

12. The fixture of claim 1 further comprising a detachable junction box.

13. The fixture of claim 12 wherein said main body portion includes a generally cylindrical neck, wherein said junction box engages said neck, and wherein a selected one of said neck and said junction box includes a channel extending circumferentially and having a mouth portion, and the other one includes a pin fitting within said mouth and channel.

14. A light fixture to be mounted within a hole in a wall or ceiling comprising:

a main body housing including a generally cylindrical neck;

a detachable junction box configured to fit upon said neck;

a pin and a channel sized to engage said pin, one of said pin and said channel being located on said neck, the other one being located on said junction box.

15. A method of mounting a light fixture within a hole in a ceiling or wall comprising the steps of:

with a mounting clip affixed to the light fixture in a first withdrawn position in which the mounting clip is contained at least partially within a housing of the fixture in a position that permits ingress and egress of the fixture relative to the hole, placing the fixture within the hole; then moving the mounting clip from the first position to a second extend position, including moving a portion of the mounting clip from within the housing, through an aperture in said housing, to outside the housing; and locking the clip in the second position so that the portion of the mounting clip outside the housing prevents withdrawal of the fixture from the hole, said locking including seating a shoulder of said clip by moving a neck of said clip along an axial portion of said aperture narrower than said shoulder and allowing said tension of the clip to push said shoulder inward toward said housing until said shoulder is seated.

16. The method of claim 18 wherein said mounting clip is tensioned to return toward said first position from said second position, and wherein said moving step includes pushing said mounting clip partially through said mounting clip aperture.

17. The method of claim 15 further including removing the fixture from the hole including:

releasing the mounting clip from the locked position by moving a free end of the clip longitudinally, and then passing a portion of the clip through its aperture in an inward direction relative to the housing.

18. A light fixture to be mounted in a hole in a wall or ceiling comprising:

a housing for containing a light source, said housing having an outside wall;

an aperture in said outside wall;

a mounting clip having a first portion affixed to said housing and having a second portion extending through said aperture and into said housing;

said mounting clip applying tension that urges said second portion generally inward with respect to said housing;

a neck and shoulder located on said mounting clip second portion, said neck being narrower than said shoulder;

said aperture having a horizontal portion wider than said shoulder and a vertical portion narrower than said shoulder but wider than said neck so that said neck can travel into said vertical portion;

wherein said mounting clip is sufficiently flexible to permit said second portion of said clip to be moved outwardly through said horizontal portion of said aperture against said tension of said mounting clip so that said neck can be moved into said vertical portion of said aperture, the tension of said mounting clip urging said shoulder inward, against said outside wall adjacent said vertical portion, thereby to fix said mounting clip in an extended position to prevent said housing from moving through the hole.

19. The fixture of claim 18 wherein said mounting clip is affixed to said housing at a point located below said aperture.

* * * * *